United States Patent [19]

Matsuda

[11] Patent Number: 4,817,936

[45] Date of Patent: Apr. 4, 1989

[54] SPRING-POWERED TOY

[75] Inventor: Takashi Matsuda, Tokyo, Japan

[73] Assignee: Takara Co., Ltd., Tokyo, Japan

[21] Appl. No.: 180,287

[22] Filed: Apr. 11, 1988

Related U.S. Application Data

[63] Continuation-in-part of Ser. No. 920,305, Oct. 16, 1988, Pat. No. 4,736,943.

[51] Int. Cl.[4] ..... A63J 23/00; A63H 13/16

[52] U.S. Cl. ..... 272/27 R; 272/27 N; 446/310; 446/464

[58] Field of Search ..... 272/27 N, 27 R; 446/51, 446/52, 53, 72, 73, 76, 79, 308–310, 75, 354, 353, 352, 457, 464, 431, 491

[56] References Cited

U.S. PATENT DOCUMENTS

| | | | |
|---|---|---|---|
| 608,794 | 8/1898 | Quinn | 446/310 |
| 1,202,301 | 10/1916 | Mackaye | 446/310 |
| 2,809,834 | 10/1957 | Frampton | 272/27 R |
| 3,037,779 | 6/1962 | Duncan | 446/310 X |
| 3,586,320 | 6/1971 | Mace | 272/27 N |
| 4,356,662 | 11/1982 | Strasser et al. | 446/52 |
| 4,464,860 | 8/1984 | Onodera | 446/491 |
| 4,736,943 | 4/1988 | Fukuba et al. | 272/27 R |

*Primary Examiner*—John E. Murtagh
*Assistant Examiner*—Richard E. Chilcot, Jr.
*Attorney, Agent, or Firm*—Price, Gess & Ubell

[57] ABSTRACT

A windup spring toy contained within a divisible housing can be wound up via an external winder. Upon release and after a predetermined amount of time has elapsed, the housing divides, allowing the windup toy to emerge.

5 Claims, 5 Drawing Sheets

SPRING-POWERED TOY

This is a continuation-in-part of copending U.S. patent application Ser. No. 920,305, filed Oct. 16, 1986, now U.S. Pat. No. 4,736,943.

BACKGROUND OF THE INVENTION

The present invention relates to a combination toy wherein energy is stored by turning a portion of a hollow housing container, whereby once released from the human hand which held the combination toy, and when a specific duration of time has elapsed, the hollow housing container divides itself and exposes a self-powered mobile toy member that travels using previously stored energy.

The applicant proposed such a combination toy in U.S. patent application Ser. No. 920,305 filed Oct. 16, 1986, now U.S. Pat. No. 4,736,943, wherein a hollow housing container comprises two independent half shell members and each half shell member is provided with a connecting member protruding toward a self-powered mobile toy, whereby the self-powered mobile toy is provided with retaining means which connects the toy with the respective connecting members when the toy is housed in the hollow housing container, as well as with means for releasing the toy member from the container in conjunction with the rotation due to the output of spring power mechanism on the self-powered mobile toy member.

Being provided not only with a spring power mechanism but with means for maintaining and canceling connection with the housing container, the self-powered mobile toy member inevitably has complicated construction and appearance, and there are difficulties in miniaturizing the toy member as well as in providing a mechanism for endowing the toy member with other actions.

The object of the invention is, in view of the disadvantages mentioned above, to provide a hollow housing container with spring windup means, a connecting portion for connecting half shell members together, retaining means for maintaining the connection, and means for releasing the above connection, in order to simplify the construction of the self-powered toy member thereby allowing the simplification of appearance and miniaturization thereof, and enabling incorporation of a mechanism for endowing the toy member with other actions.

SUMMARY OF THE INVENTION

To solve the disadvantages mentioned above, the present invention has the following construction:

a. On the exterior of a self-powered mobile toy member is protruding an input/output axle of spring drive means, on which tip is provided with coupling means;

b. separable connecting means serving as the connecting portion is provided to both half shell members which form the hollow housing container; and c. one of the half shell members comprises; a spring member that exerts upon said connecting means a resilient force toward the direction for disconnection; rotary knob for winding up a driving spring; coupling means installed on the inner side end of the axle of the rotary knob, and capable of being coupled with said coupling means on the spring powered mobile toy housed in the hollow housing container; connection retaining means for maintaining the connecting state of said connecting means; and connection releasing means for canceling the connecting state of said connecting means by the output rotation of said spring drive means.

When a spring powered mobile toy is loaded into a hollow housing container, and two half shell members are put together, the coupling member on the hollow housing container and the coupling member on the spring powered mobile toy are engaged with each other, and, at the same time, the two half shell members are connected by a connecting portion, thereby the connecting state is maintained by the operation of a connection retaining portion.

When a rotary knob is turned, a driving spring in a spring drive mechanism is wound up via the coupling portion between the axle of the knob and the spring powered mobile toy.

Once the hollow housing container is released from the human hand, the driving spring outputs the stored power, the axle on the rotary knob is thereby rotated in the reverse direction, and, when a specific number of turns is completed, a connection retaining member is activated and the connection of two half shell members is canceled. By virtue of a spring member, the two half shell members are separated, thereby the spring powered mobile toy falls onto a floor and runs or walks by the output of the spring drive mechanism.

BRIEF DESCRIPTION OF THE DRAWINGS

The attached drawings illustrate the preferred embodiments of the invention.

DETAILED DESCRIPTION OF THE PREFERRED EMBODIMENTS

Figure 1:
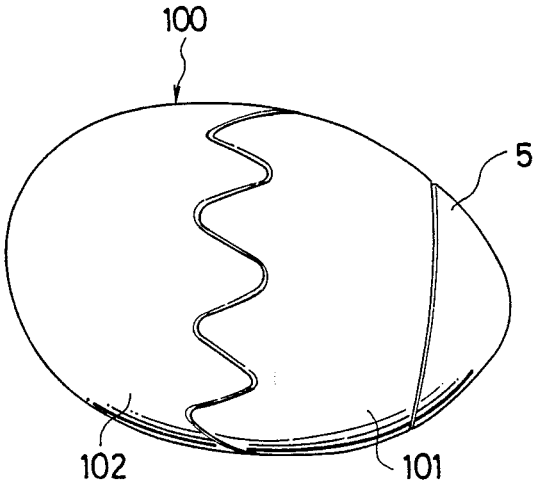
FIG. 1 is a perspective view illustrating the appearance of a hollow housing container presently containing a self-powered mobile toy member.

The preferred embodiments of the present invention are hereinafter described referring to the drawings.

The combination toy according to the invention comprises a hollow housing container 100 divisible into two halves i.e. right and left halves, and a self-powered mobile toy member 200 provided with a spring drive mechanism and capable of running or walking on a flat plane.

The hollow housing container 100 comprises two independent half shells 101 and 102, wherein the hollow housing container 100 constitutes, in its undivided state, or, when two half shells are put together, a single form i.e. an "egg." The independent half shell member 101 (102) comprises an outer shell 31 (32), disposed at a specified location therein, an inner shell 51 (52) having a recess 41 (42), whereby when both half shells are put together, a housing space 80 for housing the self-powered mobile toy member 200 described later is formed between both inner shell 51 and 52.

On each of the inner shells are installed the following movable members. Located on one end face 4 of the half shell member 101, a rotary knob 5 for winding up the spring that in appearance constitutes the tip portion of the half shell member 101 is installed on an axle 7 which is rotatably supported by a bearing 6 installed on the half shell member 101. On the other end of the axle 7 in the half shell member is secured a gear 61.

The end face 4 above rotatably supports another axle 8 penetrating there. This axle 8 extends from inside the rotary knob 5 to inside the recess 41 on the inner shell 51 and is capable of sliding parallel with the axle of the end face 4. On the axle 8, between inside the end face 4 and the internal shell 51, is secured a gear 62 which mesh with the gear 61, wherein the axle 8 has, toward the rotary knob 5, a stopper 9 that prevents the axle 8 from being out of position, and on the end to the internal shell a coupling member 10 that protrudes into the housing space 80. A spring 11 winding around the axle 8 between the end face 4 and the gear 62 constantly forces the coupling member 10 toward the middle of the housing space 80. Spring windup means comprises the rotary knob 5, the axle 7, the gears 61 and 62, the axle 8, and the coupling member 10.

In positions not interfering with the space 80, and on the respective faces opposing with each other, the half shell members 101 and 102 have, correspondingly, connecting members 12 and 13 which extend to the respective counterparts, wherein the connecting member 13 on the half shell member 102 has a rod-form, and the other connecting member 12 on the other half shell member 101 has a tube-form and is capable of accepting the rod. The tube has a notch 15 that guides a stepped portion 14 formed on the tip of rod when the rod is inserted into the tube and the two half shell members are put together to form the "egg." The connecting members 12 and 13 form the connecting portion of the hollow housing container 100.

In the half shell member 101 provided with the spring windup means, a lever 17 is swingably supported by a shaft 16 secured on the internal shell 51, whereby being forced by a spring 18 one end of which secured on the internal shell 51, one end 17*a* of the lever 17 is engaged into the notch 15 on the tube 12. This lever 17 being forced constitutes the connection retaining portion. The tip of the rod 13 is round-shaped, whereby when the rod 13 is inserted into the tube 12, the tip of the rod 13 forces the end of the lever 17 out of the notch 15 and enters the tube 12. Once the half shell members are put together, the stepped portion 14 is engaged with the notch 15, whereby the force of spring 18 allows the end 17*a* of the lever 17 to resume the former position i.e. the end 17*a* is engaged with the notch 15 and the stepped portion 14. Accordingly, the connection between the half shell members is ensured, so that the hollow housing container maintains the "egg" form.

On an axle 19 rotatably supported by the internal shell 51 is secured another gear 63 that meshes with the gear 61, and the axle 19 is provided with a cam 20 that engages with a click 17*b* formed on the other end of the lever. The cam 20 is secured on the axle 19 by means of friction. As far as the torque exerted between the cam and the axle does not exceed the friction, the cam 20 rotates in conjunction with the axle; the cam slips on the axle when the torque between the cam and the axle exceeds the friction.

Figure 6:
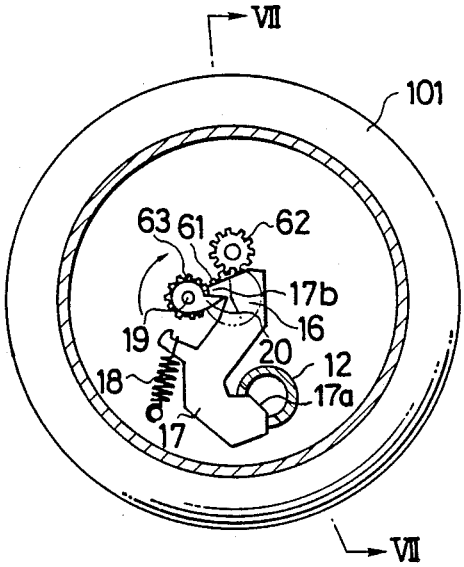
FIG. 6 is a cross section taken on line VI—VI of FIG. 5.
Figure 7:
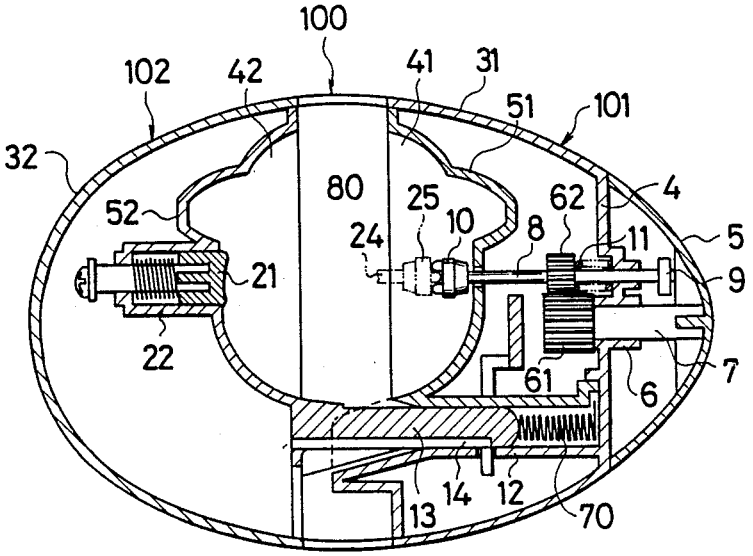
FIG. 7 is a cross section taken on line VII—VII of FIG. 6.

When the gear 61 rotates, and drives the gear 63 counterclockwise as shown in FIG. 6, the cam 20 and the click 17*b* of the lever 17 come into contact with each other as forced toward opposite directions on the common plane, thereby a torque exceeding the friction is exerted on the cam 20, and the cam 20 slips on the axle 19. In contrast, when the gear 63 is driven clockwise in the same figure, the cam 20 and the click 17*b* of the lever 17 contact on the respective curve faces, and, accordingly, without slipping, the cam 20 further rotates and turns the lever 17 on the axle 16 by overriding the tension of the spring 18. Correspondingly, the tip 17*a* of the lever 17 is released from the notch 15 in the connecting portion, and the connection of the half shell members 101 and 102 is disrupted.

In short, the axle 8, gears 62 and 63, axle 19, and cam 20 combinedly constitute the connecting/releasing portion of the half shell members.

In the other half shell member 102, on a position facing the housing space 80 is disposed a protrusion 21 for releasing outside the self-powered mobile toy member 200 housed in the housing space 80, wherein the protrusion 21 is constantly energized in a direction for releasing the toy member 200 outside.

The self-powered mobile toy member 200 contains a spring drive mechanism (unshown) having a known construction such as that disclosed in U.S. Pat. No. No. 4,736,943, whereby a known transmission mechanism (unshown) comprising a cam, lever and the like, such as that disclosed in U.S. Pat. No. 4,736,943, and connected to the spring drive mechanism enables the toy member 200 to walk using both legs 23 alternately moving forward and rearward.

According to the present invention, an input/output axle 24 for winding up the spring in spring drive mechanism and for outputting the stored energy is partially exposed outside, wherein the tip of the input/output axle 24 is provided with a coupling member 25 that is engaged with the coupling member 10 provided on the half shell member 101 of the hollow housing container 100. These coupling members 10 and 25, once coupled together, combinedly constitute a structure where a protrusion of one member engages with a recess of the other member, thus rotation of one member rotates the other.

Figure 8:
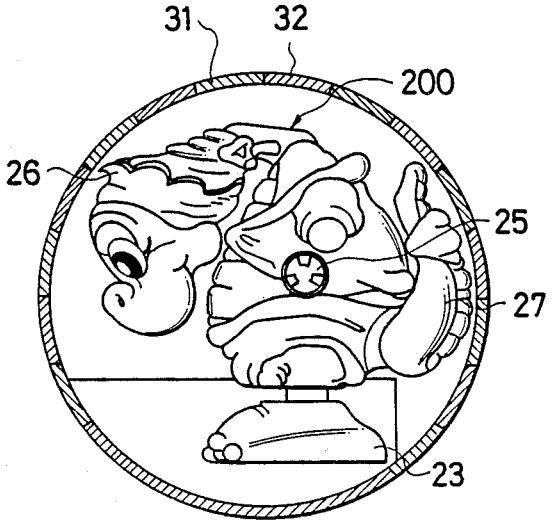
FIG. 8 is a cross section, where the hollow housing container contains a self-powered mobile toy member.
Figure 9:
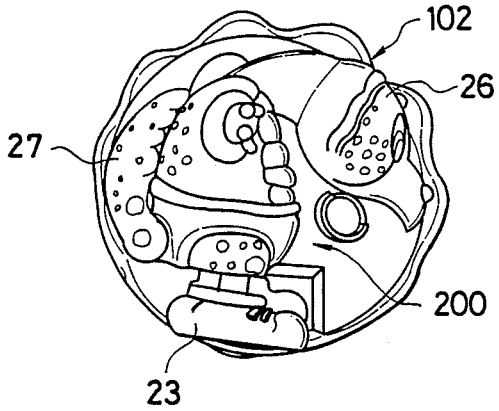
FIG. 9 is a perspective view illustrating one side of a self-powered mobile toy member housed in a hollow housing container.
Figure 10:
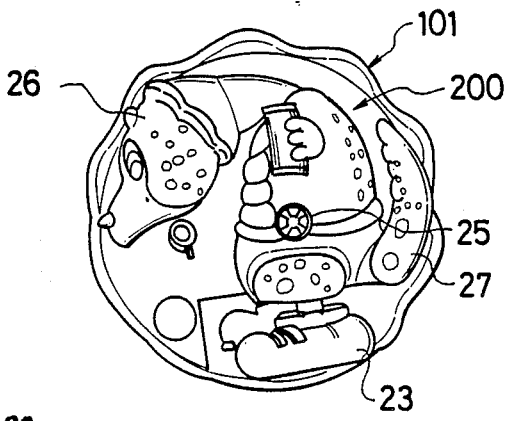
FIG. 10 is a perspective view illustrating the other side of the same toy member.

According to the shown embodiment, the self-powered toy member 200 has an animal form. For allowing each loading into the hollow housing container and for ensuring better appearance after releasing from the container, the toy member 200 is provided, respectively in the neck 26 and the tail 27, with a spring stiffener, wherein the toy member 200 is contained in the housing container after its neck and tail being folded as shown in FIG. 8.

Figure 11:
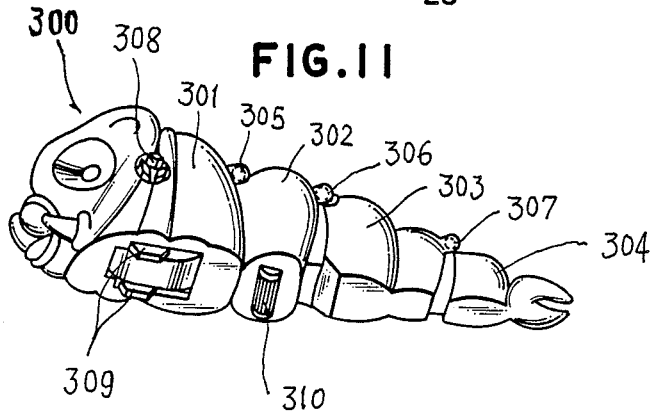
FIG. 11 illustrates a different example of a self-powered mobile toy member.

As far as the size and configuration are appropriate for the hollow housing container, the shape of the toy member 200 is not limited only to the shown example, and arbitrarily selected shape may be employed, for example, such as shown in FIG. 11.

According to the constitution above, once the self-powered mobile toy member 200 is inserted into the hollow formed between the recesses 41 and 42 respectively on the half shell members 101 and 102 and then, the connecting member 13 on the half shell member 102 is inserted into the other connecting member 12 on the other half shell member 101 in order to put both half shell members together, the end 17*a* of the lever 17 is engaged with the notch 15. Accordingly, the half shell members are maintained in connected state by virtue of the operation of the connecting portion, whereby the self-powered mobile toy member 200 is contained unseen from the outside and the hollow housing container remains in the "egg" form. Additionally, the input/ouptut axle 24 is coupled to the axle 8 on the housing container by the coupling members 25 and 10.

While the exterior of the hollow housing container 100 is held by human hand, and when the rotary knob 5 is turned to a specified direction, the gear 61 is rotated clockwise as shown in FIG. 6, thereby the gear 62 meshed with the gear 61 rotates the axle 8, and the spring in the spring drive mechanism of the self-powered mobile toy member is wound up. While the spring windup portion is operated, the cam 20 receives counterclockwise rotating force as shown in FIG. 6 via the gear 63 meshed with the gear 61. However, the cam 20 does not turn, because its movement is limited by the click 17*b* on the lever 17, and, accordingly, the lever is not turned, thereby the half shell members remain undivided.

Figure 2:
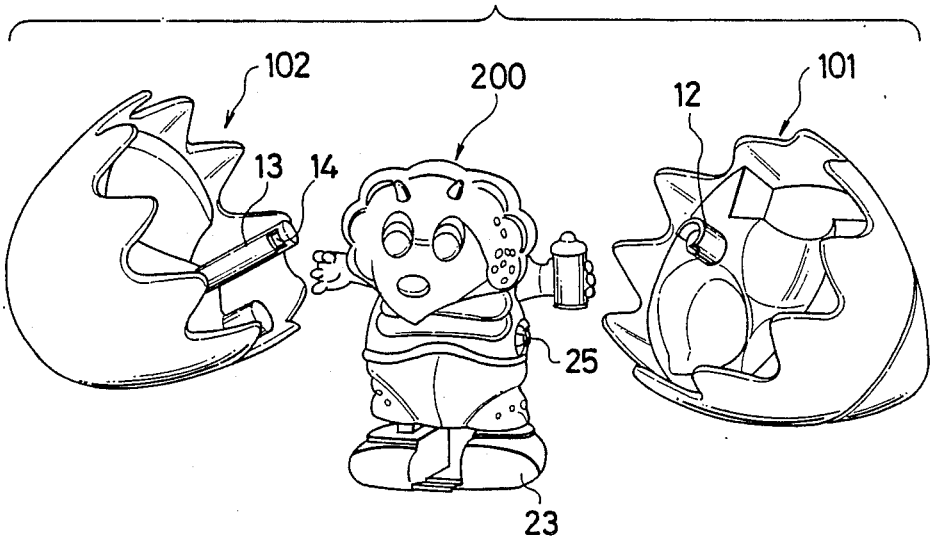
FIG. 2 is a perspective view, where after having been released from the divided hollow housing container, a self-powered mobile toy member is walking.
Figure 3:
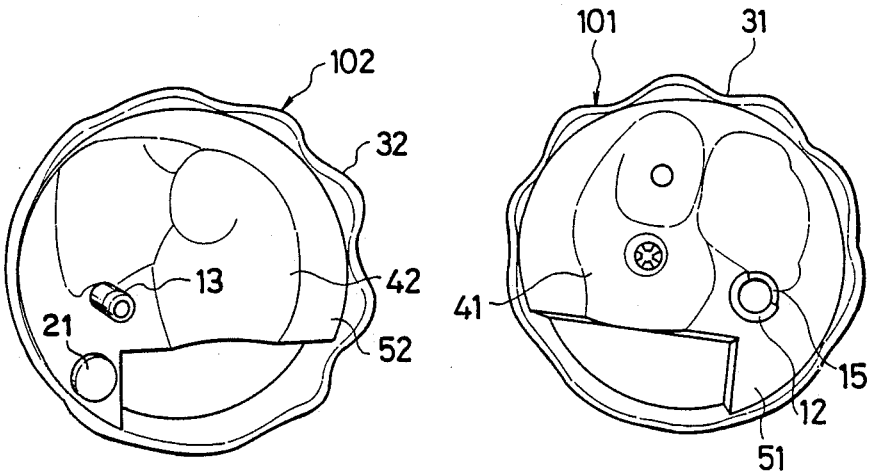
FIG. 3 is a perspective view illustrating the interior of each of the individual half shell members of the hollow housing container.
Figure 4:
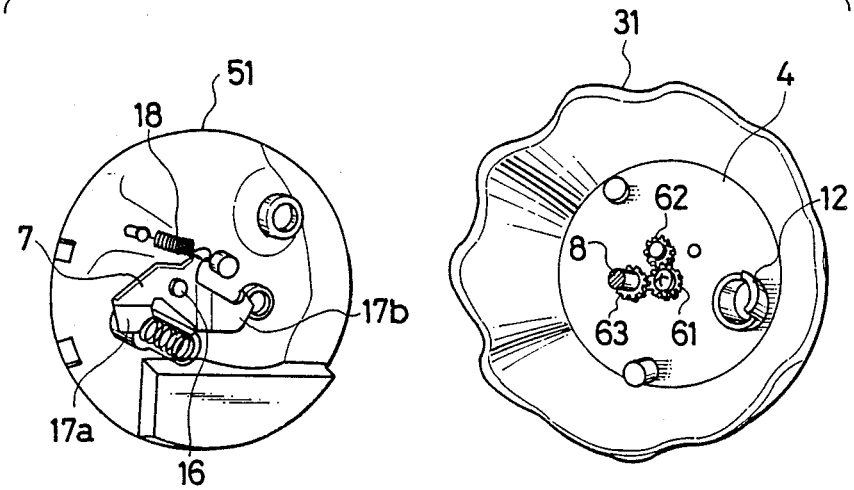
FIG. 4 is an exploded perspective view illustrating one independent half shell member.
Figure 5:
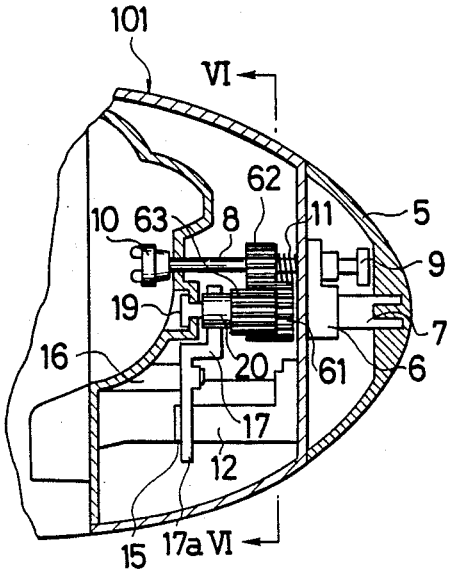
FIG. 5 is a partial vertical section of the hollow housing container.

Next, when the combination toy is placed on a floor, and released from human hand, the spring in the spring drive mechanism of the self-powered toy member outputs power that reverses the rotation of the input/output axle 24, the axle 8 on the hollow housing container 100 is thereby rotated in the reverse direction via the coupling members 25 and 10. Correspondingly, the cam 20 is also driven clockwise direction relative to FIG. 6, by the gears 62 and 63. Once a click of the cam 20 reaches the click 17*b* of the lever 17, that is, when a specific duration has elapsed since the combination toy was released from human hand, the click of the cam 20 turns the lever 17, and, accordingly, the end 17*a* of the lever 17 is disengaged from the notch on the connecting member 12 and disconnection is performed. Correspondingly, the half shell members 101 and 102 are shifted to directions opposite with each other by the resilient force of a spring member 70 disposed in the connecting member 12, thereby the hollow housing container 100 is divided into two independent half shell members as shown in FIG. 2.

The self-powered mobile toy member 200 housed in the hollow housing container 100 is separated from the respective half shell members 101 and 102 by the forces of the spring 11 on the axle 8 and the spring 22 on the protrusion 21; the self-powered mobile toy member 200 housed in the hollow housing container in the "egg" form is released therefrom, and falls onto a floor and starts walking by the power of spring drive mechanism. This gives an observer an impression that an animal splits the eggshell and is born therefrom, and starts toddling. According to this embodiment, as soon as the animal escapes from the egg, its neck 26 stretches upright, and the tail 27 droops respectively by the force of a spring. Additionally, a swinging mechanism (unshown) may swing the neck and tail in conjunction with the output of the spring drive mechanism.

FIG. 11 shows a different configuration of the self-powered mobile toy member.

In FIG. 11, a self-powered toy member 300 simulates a green caterpillar. Each of body parts 301, 302, 303, 304 is connected together through pins 305, 306, 307. In FIG. 11, the reference numeral 308 denotes a coupling member which is engaged with a coupling member provided on a corresponding a half shell member of a hollow housing container, while the reference numeral 309 denotes legs and the reference numeral 310 denotes a roller rotatably mounted on the bottom of the body part 302.

As described above, according to the invention, a hollow housing container is provided with spring windup means, a connecting portion for connecting half shell members together, retaining means for maintaining the connection, and means for releasing the above connection, and, thus, the constitution of the self-powered toy member is simplified, thereby allowing the simplification of appearance and miniaturization thereof, and enabling incorporation of a mechanism for endowing the toy member with other actions.

What is claimed is:

1. A combination toy comprising;

i. a hollow housing container having two half shell members separably connected together to form a single shell form, and internally having a housing space when two shell members are connected together; and a spring powered mobile toy capable of being housed in said housing space in said hollow housing container, and having spring drive means that makes by its output said toy member to be movable;

ii. an input/output axle for said spring drive means disposed on the external face of said spring powered mobile toy, and on the tip thereof is provided with coupling means;

iii. wherein said hollow housing container comprises a. spring windup means having an axle that is capable of being coupled with said coupling means of said input/output axle of said spring powered mobile toy housed in said housing space;

b. connecting means for connecting half shell members;

c. connection retaining means for maintaining the connecting state of said connecting means d. and connection releasing means for canceling the connecting state of said connecting means by the output rotation of said input/output rotation of said self powered mobile toy.

2. An improved combination toy having a divisible hollow housing in which is contained a separable self-powered mobile toy member which toy, upon release and after a predetermined amount of time has elapsed, causes the housing to divide into housing parts and the mobile toy member to emerge, the improvement comprising:

means for releasably and directly interconnecting the housing parts whereby the housing is held together in its undivided state without any restraining interaction with the mobile toy member contained therein;

wherein said interconnecting means comprises:

a notched shaft directly connected to a first housing part;

an engaging means, capable of receiving the notched shaft, directly connected to a second housing part; and means for releasably retaining the shaft within said engaging means.

3. The improved toy of claim 2 wherein the means for releasably retaining the notched shaft within said engaging means comprises a movable engaging member that engages the notch in the shaft when inserted in said engaging means.

4. The improved toy of claim 3 further comprising a biasing means for biasing the shaft against insertion into said engaging means whereby upon disengagement of the engaging member from the notch in the inserted shaft the shaft is forcibly ejected from said engaging means.

5. The improved toy of claim 4 wherein the biasing means comprises a coil spring disposed within said engaging means so as to be compressed upon insertion of the notched shaft.

* * * * *